US007325348B2

(12) United States Patent
Mueller et al.

(10) Patent No.: US 7,325,348 B2
(45) Date of Patent: Feb. 5, 2008

(54) CLIP-ON LABEL HOLDER FOR SHELF CHANNEL

(75) Inventors: Paul A. Mueller, Wadsworth, OH (US); Joseph P. Kosir, Euclid, OH (US)

(73) Assignee: Fasteners For Retail, Inc., Cleveland, OH (US)

( * ) Notice: Subject to any disclaimer, the term of this patent is extended or adjusted under 35 U.S.C. 154(b) by 0 days.

(21) Appl. No.: 10/767,834

(22) Filed: Jan. 29, 2004

(65) Prior Publication Data

US 2005/0166438 A1 Aug. 4, 2005

(51) Int. Cl.
*G09F 3/18* (2006.01)

(52) U.S. Cl. ..... 40/649; 40/661; 40/661.03; 40/661.06; D20/44

(58) Field of Classification Search ..... 40/642.02, 40/649, 661, 661.03, 661.06, 611.01; D20/43, D20/44; 248/220.22
See application file for complete search history.

(56) References Cited

U.S. PATENT DOCUMENTS 4,295,288 A 10/1981 Westberg
4,373,693 A * 2/1983 Greenberger ..... 248/220.22
4,426,797 A 1/1984 Burkemper et al.
4,557,064 A * 12/1985 Thompson ..... 40/661.03
4,866,868 A 9/1989 Kass
5,044,104 A 9/1991 Hopperdietzel
5,263,269 A 11/1993 Tjärnlund
5,394,632 A * 3/1995 Gebka et al. ..... 40/661.03
5,419,066 A 5/1995 Harnois et al.
5,473,833 A 12/1995 Ostrovsky
5,577,337 A 11/1996 Lin
5,899,011 A * 5/1999 Brinkman ..... 40/661.03
5,967,343 A * 10/1999 Dufresne ..... 211/86.01
6,026,603 A * 2/2000 Kump et al. ..... 40/661.03
D425,566 S 5/2000 Meuller et al.
6,082,687 A 7/2000 Kump et al.
6,105,295 A * 8/2000 Brinkman et al. ..... 40/661.03
6,119,990 A 9/2000 Kump et al.
6,226,910 B1 5/2001 Ireland
6,266,906 B1 7/2001 Nagel
D453,798 S * 2/2002 Gray ..... D20/43
6,354,546 B1 * 3/2002 Mueller ..... 248/220.42
6,357,154 B1 3/2002 Pfendler et al.
6,470,613 B1 * 10/2002 Wildrick ..... 40/661.03

(Continued)

OTHER PUBLICATIONS

FFR Yellow Pages, 2002 Product Catalog, cover page, and pp. 36-40, 78, 81, 83-84, 98, 101-103, back page.

(Continued)

*Primary Examiner*—Gary C. Hoge
(74) *Attorney, Agent, or Firm*—Fay Sharpe LLP

(57) ABSTRACT

A holder for a label includes a cover panel having a front surface, a rear surface, an upper end, and a lower end. The holder further includes a body panel having a front surface, a rear surface, an upper end, and a lower end. A hinge connects the lower end of the cover panel with the lower end of the body panel wherein the cover panel includes an upper portion which is disposed at an acute angle in relation to a plane of a remainder of the cover panel. The rear surface of the cover panel and the front surface of the body panel define a pocket therebetween for selectively accommodating an associated label.

37 Claims, 6 Drawing Sheets

U.S. PATENT DOCUMENTS

| | | | | |
|---|---|---|---|---|
| 6,553,702 | B1 | 4/2003 | Bacnik | |
| D479,278 | S | 9/2003 | Nagel | |
| 6,688,567 | B2 | 2/2004 | Fast et al. | |
| 6,708,436 | B2 | 3/2004 | Nagel | |
| 6,868,629 | B2 * | 3/2005 | Fast et al. | 40/661.03 |
| 2004/0200793 | A1 * | 10/2004 | Hardy | 211/119.003 |
| 2004/0250459 | A1 | 12/2004 | Brinkman et al. | |
| 2005/0133676 | A1 | 6/2005 | Brinkman et al. | |

OTHER PUBLICATIONS

EZ-View Catalog, vol. 2, cover page and p. 20, Apr. 1997.
FIT-All Pricing Corporation catalog, p. 11.
August Fisher GmbH catalog page, Apr. 1991.
Bentler GmbH catalog page.

* cited by examiner

CLIP-ON LABEL HOLDER FOR SHELF CHANNEL

BACKGROUND OF THE INVENTION

The present invention relates to label holders for displaying information-containing labels or signs and, more particularly, holders which are cost effective, convenient to manufacture, and adapted for secure attachment to a wide variety of retail shelving in a manner which facilitates convenient viewing of associated labels.

Merchandise shelves commonly found in supermarkets and the like generally provide a substantially C-shaped price channel along the front edge. The merchandise shelves can also be modified to include a C-shaped price channel. Such price channels have upper and lower flange members along their edges and can be used to accommodate snap-in labels or sign holders adapted to receive and display non-adhesive paper or plastic labels or signs containing bar coding or printed pricing or other such information for the consumer. Non-adhesive labels are less expensive to manufacture when compared to adhesive backed labels. Additionally, non-adhesive labels can generally be installed and removed much more readily. Moreover, the appearance of shelving provided with label holders adapted to removably receive non-adhesive labels is dramatically improved.

Depending upon the type of shelving, the price channel configuration may be different. Although the size of most price channels is fairly standard, no two shelves are exactly alike. Thus, the height of the channel formed between the upper and lower flange members may vary because of manufacturing tolerances, even on different shelves of the same shelf system.

Various attachments are currently on the market for adapting a C-channel to removably receive and display non-adhesive information-containing labels to a consumer. In most versions, one or more rearwardly extending flexible legs are provided with portions designed to snap into the upper and lower flanges of the C-channel. While such attachments may provide only upper and lower channels to receive and retain a paper or plastic label, much like the C-channel on the shelf, they commonly include a main body or backing panel and a hingedly attached transparent cover which together define a pocket between them for reception of the non-adhesive label. In some circumstances, a transparent label cover can be snapped directly onto a C-channel over the lower edge, providing a pocket for a non-adhesive label between the cover and the C-channel itself.

While each of the foregoing systems are useful, they each have limited application and one or more disadvantages. For example, while the label holders with rearwardly extending legs can accommodate C-channels of somewhat varying dimensions, they still must fit between and engage both the upper and lower flange elements, limiting their versatility.

The ease of use of the above described attachments is compromised due to the situation wherein a rear surface of the cover is in contact with a front surface of the main body panel. As such, it is difficult to grasp the cover and move it away from the main body panel in order to insert a label therebetween. Additionally, the rearwardly extending legs still must provide a sufficient retaining force when the cover is hinged and pulled away from the main body panel.

Furthermore, the shelving attachments currently on the market do not provide a mechanism for attachment of additional sign or label holders to the front cover wherein the sign holders, and the respective labels, can have different orientations.

SUMMARY OF THE INVENTION

In accordance with the present invention, a holder for a label includes a cover panel having a front surface, a rear surface, an upper end, and a lower end. A body panel is provided having a front surface, a rear surface, an upper end, and a lower end. A hinge connects the lower end of the cover panel with the lower end of the body panel. The cover panel further includes an upper portion which is disposed at an acute angle in relation to a plane of a remainder of the cover panel.

In accordance with another aspect of the present invention, a label holder includes a body panel having a front surface, a rear surface, an upper end, and a lower end. The holder further includes a first clip member extending away from the rear surface of the body panel and a second clip member extending away from the rear surface of the body panel. The second clip member is spaced from the first clip member. The second clip member includes a stem, an upwardly extending arm located adjacent a distal end of the stem, and a downwardly extending arm disposed adjacent the distal end of the stem. The first and second clip members cooperate to selectively hold a projecting portion of an associated shelf. The holder further includes a cover panel connected to the body panel. The cover panel has a front surface, a rear surface, an upper end, and a lower end.

In accordance with still another aspect of the present invention, a holder for a label includes a cover panel having a front surface, a rear surface, an upper end, and a lower end. The holder further includes a body panel having a front surface, a rear surface, an upper end, and a lower end. A hinge connects the lower end of the cover panel with the lower end of the body panel. A first sign holder is mounted to the cover panel.

In accordance with yet another aspect of the present invention, a holder for a label includes a cover panel having a front surface, a rear surface, an upper end, and a lower end. The holder further includes a body panel having a front surface, a rear surface, an upper end, and a lower end. A hinge connects the lower end of the cover panel with the lower end of the body panel. The cover panel includes an upper portion which is disposed at an acute angle in relation to a plane of a remainder of the cover panel. A first clip member extends away from the rear surface of the body panel. A second clip member extends away from the rear surface of the body panel, the second clip member is spaced from the first clip member wherein the second clip member includes a stem, an upwardly extending arm located adjacent a distal end of the stem, and a downwardly extending arm disposed adjacent the distal end of the stem. The first and second clip members cooperate to selectively hold a projecting portion of an associated shelf.

In accordance with a further aspect of the present invention, a label holder includes a rear panel and a front panel secured to the rear panel along a bottom edge of the front panel. The front panel includes a first portion which extends in a direction generally parallel to the rear panel. A second portion is connected to the first portion and extends at an acute angle in relation to a plane of the first portion. A first gripping member extends rearwardly from the rear panel for selectively securing the label holder to an associated merchandising shelf.

Still other aspects of the present invention will become apparent to those of ordinary skill in the art upon a reading and understanding of the following specification.

BRIEF DESCRIPTION OF THE DRAWINGS

The invention may take physical form in certain parts and arrangements of parts, several preferred embodiments of which are described in the specification and illustrated in the accompanying drawings which form a part hereof and wherein.

DETAILED DESCRIPTION OF THE INVENTION

Figure 3:
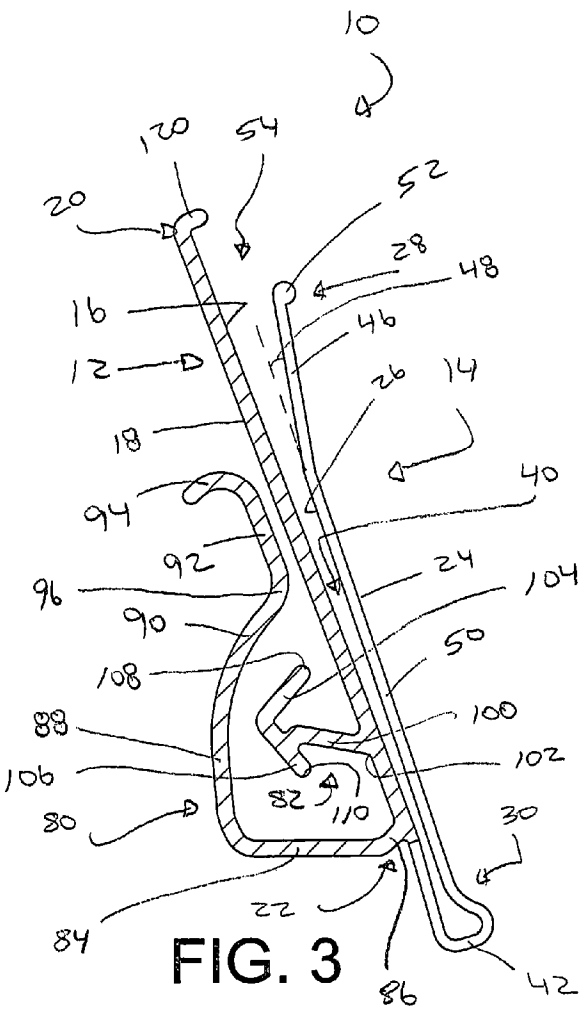
FIG. 3 is an enlarged side elevational view of the label holder of FIG. 1.

Referring now to the drawings, and particularly to FIGS. 1-4, a first embodiment of a label holder according to the present invention is designated generally by the reference numeral 10. It comprises a generally planar body or rear panel 12 and a non-planar cover or front panel 14. With reference to FIG. 3, the body panel 12 has a front surface 16, a rear surface 18, an upper end 20, and a lower end 22. The cover panel 14 has a front surface 24, a rear surface 26, an upper end 28, and a lower end 30.

It is to be appreciated that the body panel 12 and the cover panel 14 can be formed by coextrusion. The body panel 12 can include an opaque, colored, polyvinyl chloride. The cover panel 14 can be formed of a transparent polyvinyl chloride to enable a non-adhesive paper or plastic label L1 or the like (FIG. 2) to be received in a pocket 40 defined between the front surface 16 of the body panel 12 and the rear surface 26 of the cover panel 14, and viewed through the transparent cover panel 14 for scanning bar codes or the like or for visually observing printed information contained thereon.

The lower end 22 of the body panel 12 and the lower end 30 of the cover panel 14 are integrally joined at hinge 42 to provide a flexible interconnection. The interconnection biases the cover panel 14 toward the position shown in FIG. 3, but permits the cover panel 14 to bend outwardly from the body panel 12 for insertion and removal of the labels L1 or similar items from the pocket 40.

The cover panel 14 includes an upper or second portion 46 which is disposed at an acute angle 48 in relation to a plane of a remainder or first portion 50 of the cover panel 14. As best seen in FIG. 3, the acute angle 48 between the upper portion 46 and the remainder portion 50 provides for a space between the body panel 12 and the cover panel 14 proximal to the upper end 20 of the body panel 12. The upper end 28 of the cover panel 14 includes a bulbous tip 52. The body panel upper end 20 and the cover panel upper end 28 define a gap 54 therebetween which, along with the bulbous tip 52, and acute angle 48, facilitate grasping of the upper end 28 of the cover panel 14 for pivoting the cover panel 14 away from the body panel 12. This improved grasping allows fast, easy and tool-free insertion and removal of labels L1. It is to be appreciated that the thickness of material of the cover panel 14 can be less than the thickness of the material for the body panel 12 (FIGS. 3 and 4), thereby providing increased flexibility of the cover panel 14 relative to the body panel 12.

Figure 1:
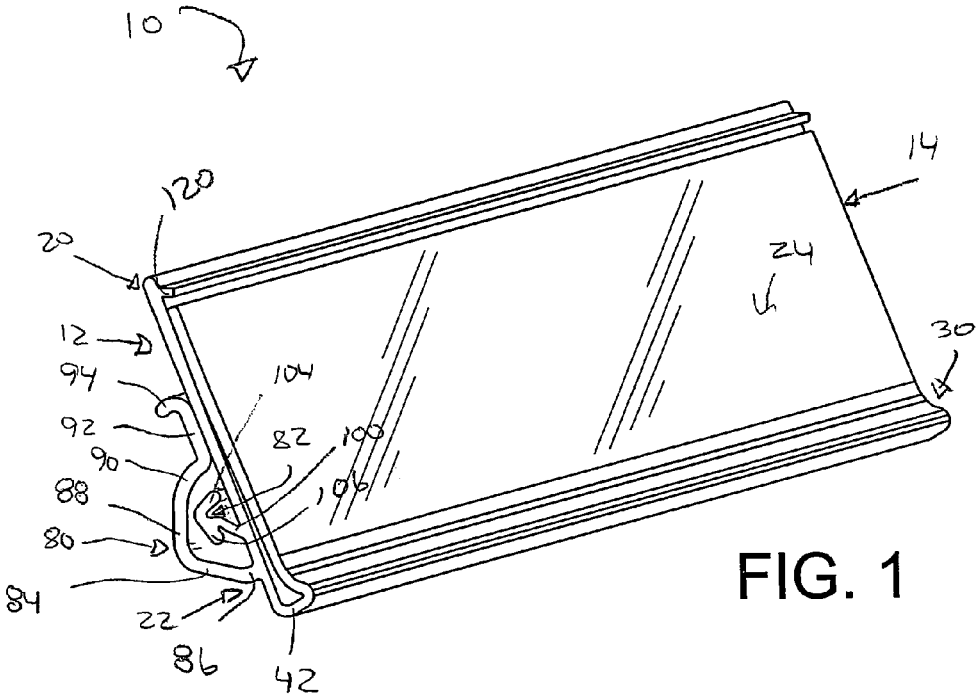
FIG. 1 is a perspective view of a label holder formed in accordance with a first embodiment of the present invention.
Figure 2:
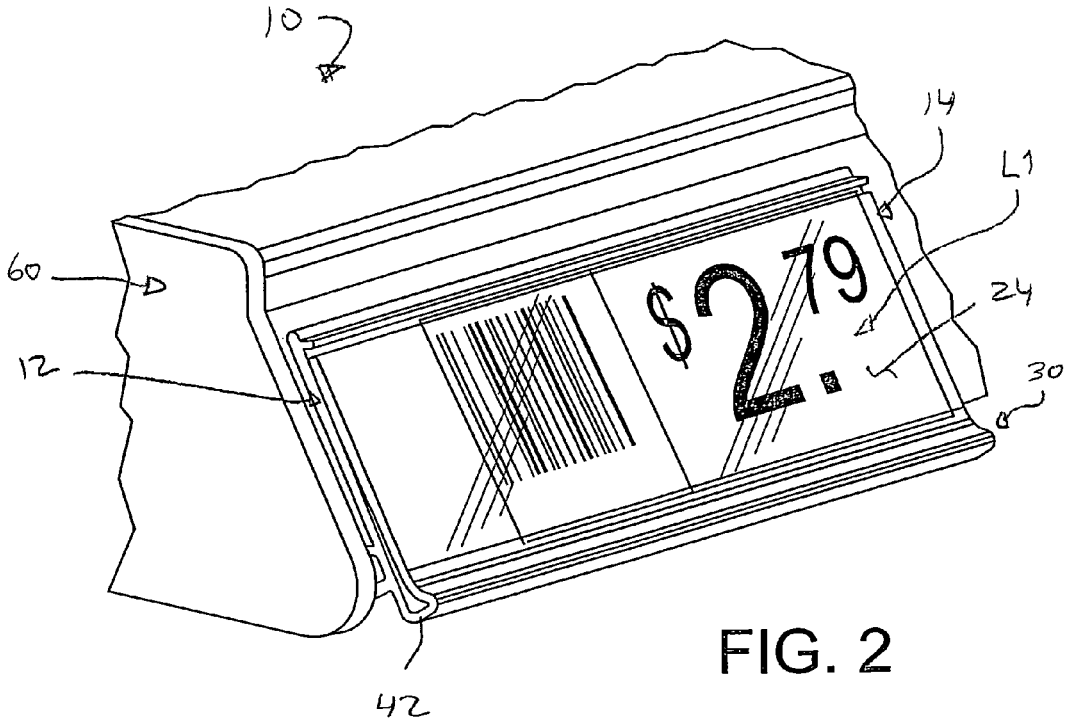
FIG. 2 is a perspective view of the label holder of FIG. 1 secured in place on a C-channel at the front of a merchandise shelf and displaying a label.
Figure 4:
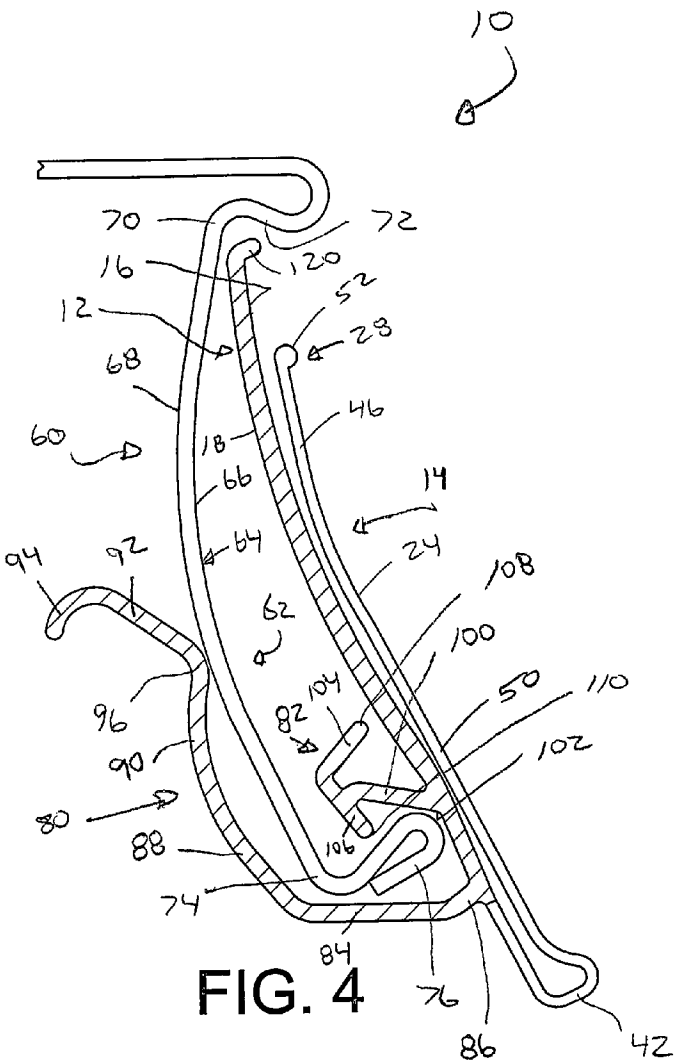
FIG. 4 is a side elevational view further illustrating the manner in which the label holder of FIG. 3 is attached to the C-channel of a shelf.

The label holder 10 is adapted to be removably secured to a merchandise shelf 60 having a channel member, such as a C-channel 62 shown in FIG. 4, formed along its front edge. The C-channel 62 commonly includes an elongated central portion 64, generally arcuate in form, having a front surface 66 and a rear surface 68. The C-channel 62 terminates in an upper edge 70, including a forwardly and downwardly extending upper flange 72, and a lower edge 74 including a forwardly and upwardly extending lower flange 76.

The specific details of the C-channel 62 or the merchandise shelf 60 are not part of the instant inventive concepts. Rather, they are conventional. However, they provide the environment in which the label holder of the present invention operates.

In order to enable the label holder 10 to be removably secured to the C-channel 62 without critical consideration of the configuration or dimensions of the C-channel 62, the body panel 12 is provided with a pair of rearwardly extending clip or gripping members 80, 82. A first portion 84 of the first clip or gripping member 80 is secured to the rear surface 18 of the body panel 12 at a point 86 proximal to the lower end 22 of the body panel 12. From the point of engagement 80 with the rear surface 18 of the body panel 12, the first clip member 80 comprises rearwardly or first and upwardly or second extending leg portions 84, 88. The first clip member 80 further includes a third portion 90, connected to the second portion 88 which extends towards the rear surface 18 of the body panel 12. Additionally, the first clip member 80 includes fourth and fifth portions 92, 94 connected to the third portion 90 and oriented generally parallel to and perpendicular to the body panel 12, respectively. An apex 96 between the third portion 90 and the fourth portion 92 of the first clip member 80 is adapted to engage the rear surface 68 of the central portion 64 of the C-channel 62 in use.

A first portion or stem 100 of the second clip or gripping member 82 is integral with or secured to the rear surface 18 of the body panel 12 at a point 102 spaced above the point 86 at which the first clip member 80 is secured. From the point of engagement 102 with the rear surface 18 of the body panel 12, the second clip member 82 comprises the rearwardly extending stem 100, an upwardly extending arm 104, and a downwardly extending arm 106, both disposed adjacent the distal end of the stem 100, thereby maintaining alignment of the stem 100. The upwardly extending arm 104 extends generally in a direction towards the rear surface 18 of the body panel 12. As is evident from the use condition shown in FIG. 4, the upwardly extending arm 104 is oriented approximately transverse to the rear surface 18 of the body panel 12. Included on arm 104 is a contact end 110 for contacting the rear surface 18 of the body panel 12 thereby limiting upward movement of the stem 100. The downwardly extending arm 106 extends generally towards the lower end 22 of the body panel 12. Provided on the downwardly extending arm 106 is a contact end 108 for contacting the lower flange member 76 of the associated shelf 60, thereby limiting inadvertent movement of the holder 10 in relation to the associated shelf 60. The first and second clip members 80, 82 cooperate to selectively hold a projecting portion of the associated shelf 60.

An upwardly and forwardly extending or protruding foot member 120 is provided at the upper end 20 of the body panel 12 to extend behind the upper flange member 72 of the channel member 64 in use. The upper foot member 120 will further secure the upper end 20 of the label holder 10 beneath the upper flange 72 of the C-channel 62 and thereby, stabilize the engagement of the label holder 10 with the channel member 62.

Figure 6:
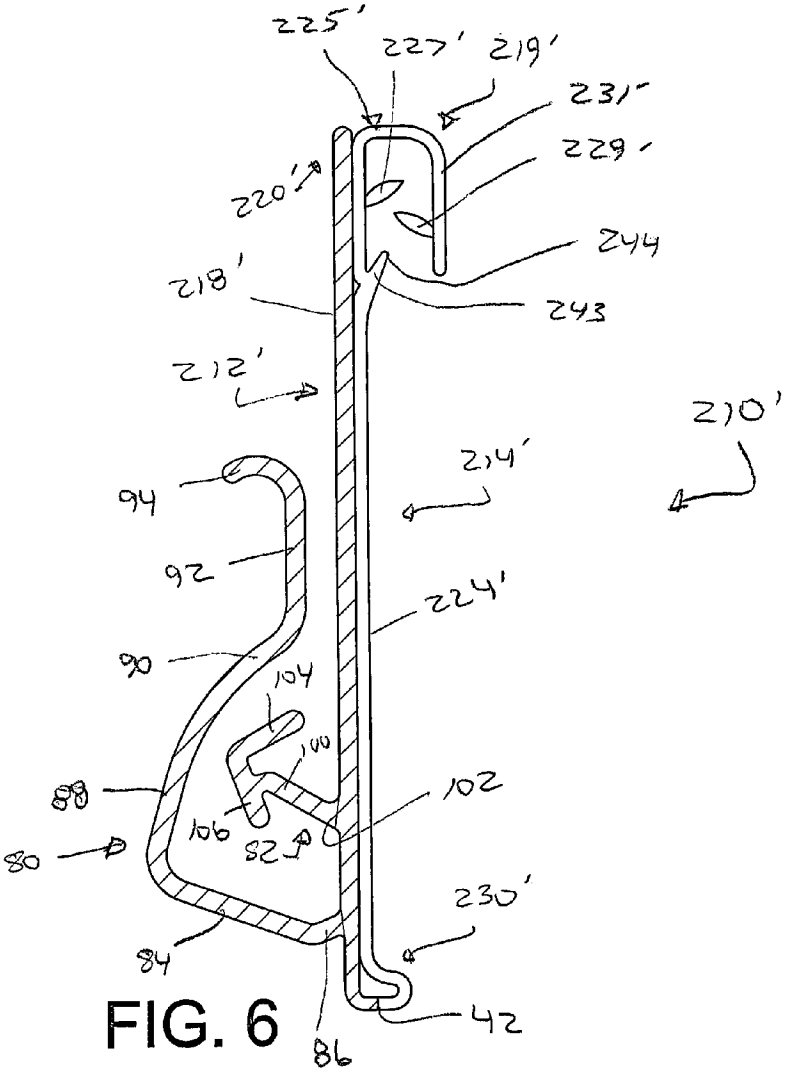
FIG. 6 is a partial cross-sectional view of the label holder of FIG. 5.
Figure 5:
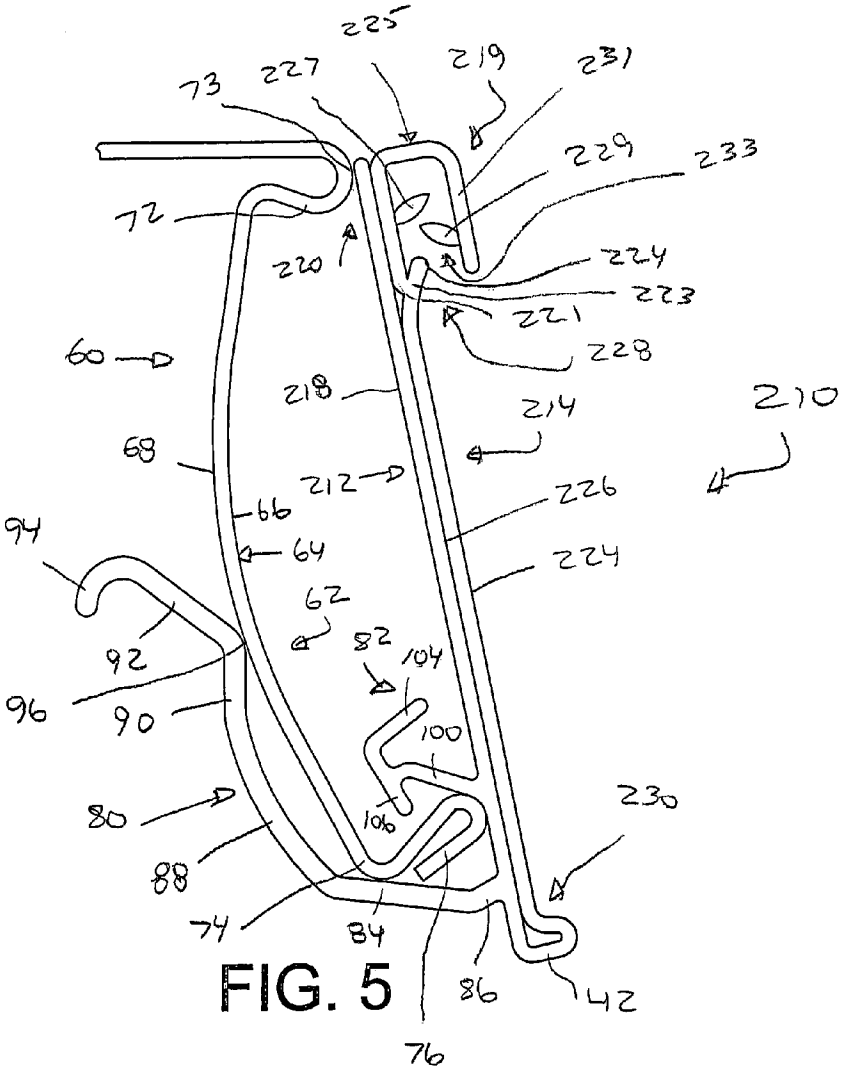
FIG. 5 is a side elevational view of a label holder formed in accordance with a second embodiment of the present invention, the holder being secured in place on a C-channel at the front of a merchandise shelf.

With reference to FIGS. 5 and 6, a second embodiment of the invention is there illustrated. Referring to FIG. 5, a first variety of the second embodiment of the label holder 210 is shown. The label holder 210 includes a body panel 212 having a front surface 216, a rear surface 218, an upper end 220, and a lower end 222. Also included is a cover panel 214 having a front surface 224, a rear surface 226, an upper end 228 and a lower end 230. The cover panel 214 is provided with a sign or second label holder 219 proximal to the upper end 228 of the cover panel 214. If desired, the sign holder 219 can be integral with or secured to the upper end 228 of the cover panel 214. The point of securement 221 includes an upwardly and forwardly extending ridge 223 offset from the cover panel 214.

As is evident from FIG. 5, the sign holder 219 comprises an overhang 225 having a first flexible fin 227 located on the cover panel 214 and a second flexible fin 229 located on the overhang 225. The fins 227, 229 each extend more than half the distance between an outer end 231 of the overhang 225 and the cover panel 214. It is to be appreciated that the fins 227, 229 can be made of a more flexible material than the cover panel 214. As shown in FIG. 5, the ridge 223 is directed towards an opening 233 between the outer end 231 and the cover panel 214. Ridge 223 feeds the upper edges of labels L2 (FIG. 7) correctly between the fins. Without the ridge, installers often will try to simply push labels along the cover panel front surface 224, thereby hitting the base of fin 227 with the upper edge of the label. As the label might hang up at that point, the ridge allows for an easier installation of the label. The overhang 225 provides a grasping surface for moving the cover panel 214 away from the body panel 212 facilitating insertion and removal of labels L1 therebetween. The rear surface 218, at the upper end 220, of the body panel 212 rests against a forward edge 73 of the upper flange 72 of an associated shelf 60 when in use. It is to be appreciated that the thickness of the plastic for the body panel 212 can be the same as the thickness of the plastic for the cover panel 214 as shown in FIG. 5.

Referring to FIG. 6, an alternative arrangement is displayed in accordance with the second embodiment. Like components are identified with like numerals including a primed (') suffix and new components are illustrated by new numerals. As shown, body panel 212' and clip members 80, 82 have a thickness greater than the thickness of the cover panel 214'. A ridge 243 on the cover panel 214', which is more pointed than the blunter ridge 223 shown in FIG. 5, correctly orients the label in relation to the fins. The fins 227', 229' provide a retention mechanism for the label. As mentioned, the ridges 223, 243 on the cover panels 214, 214' can terminate in a rounded tip 224 (FIG. 5) or a pointed tip 244 (FIG. 6).

Figure 7:
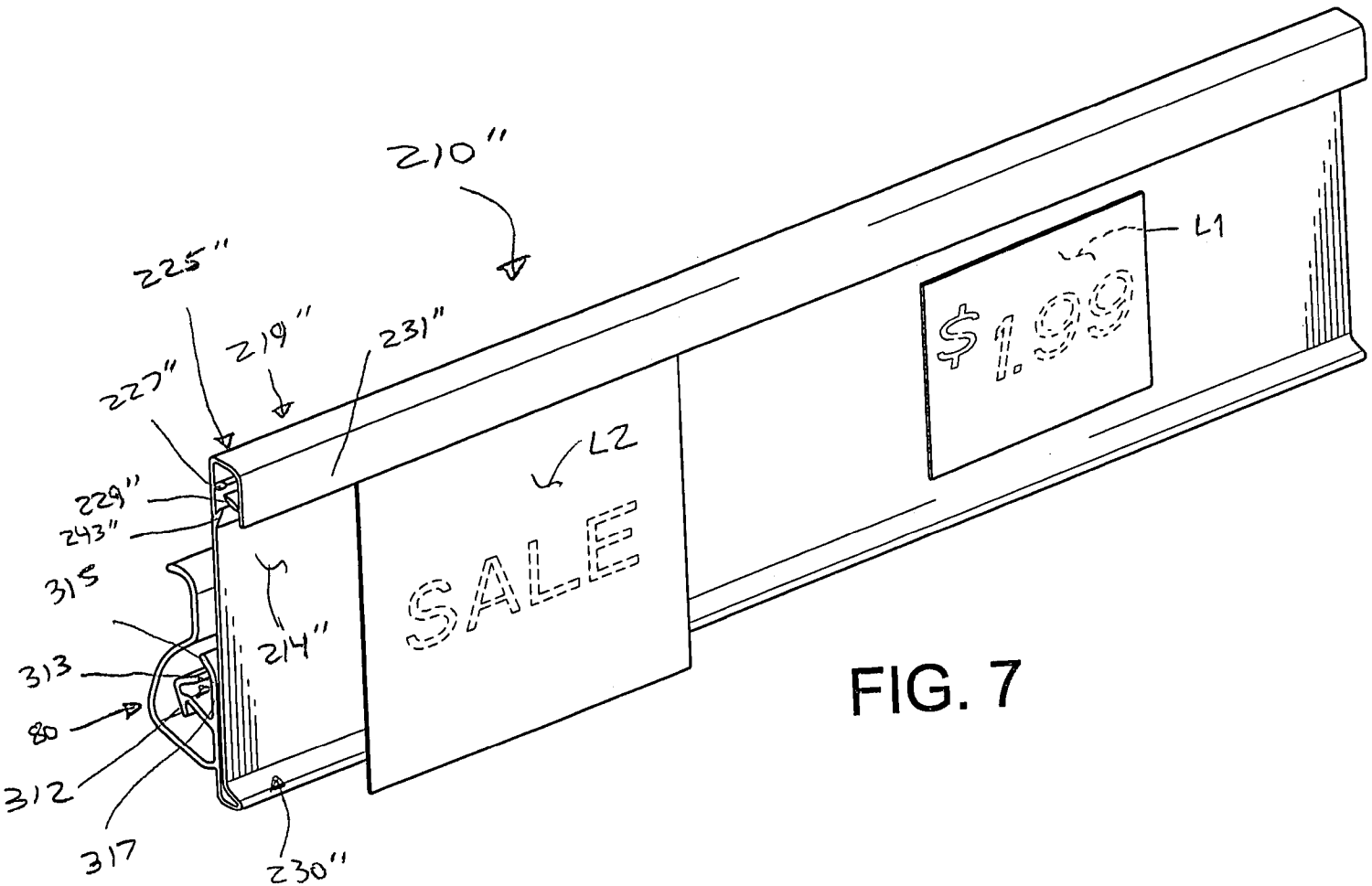
FIG. 7 is a perspective view of a label holder formed in accordance with a third embodiment of the present invention.
Figure 9:
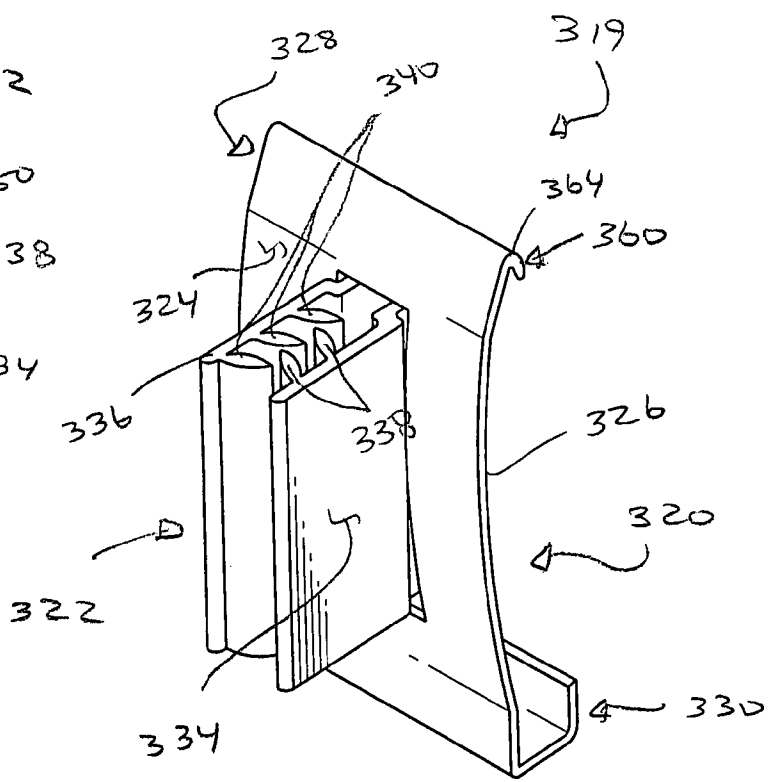
FIG. 9 is an assembled perspective view of the sign holder illustrated in FIG. 8.
Figure 8:
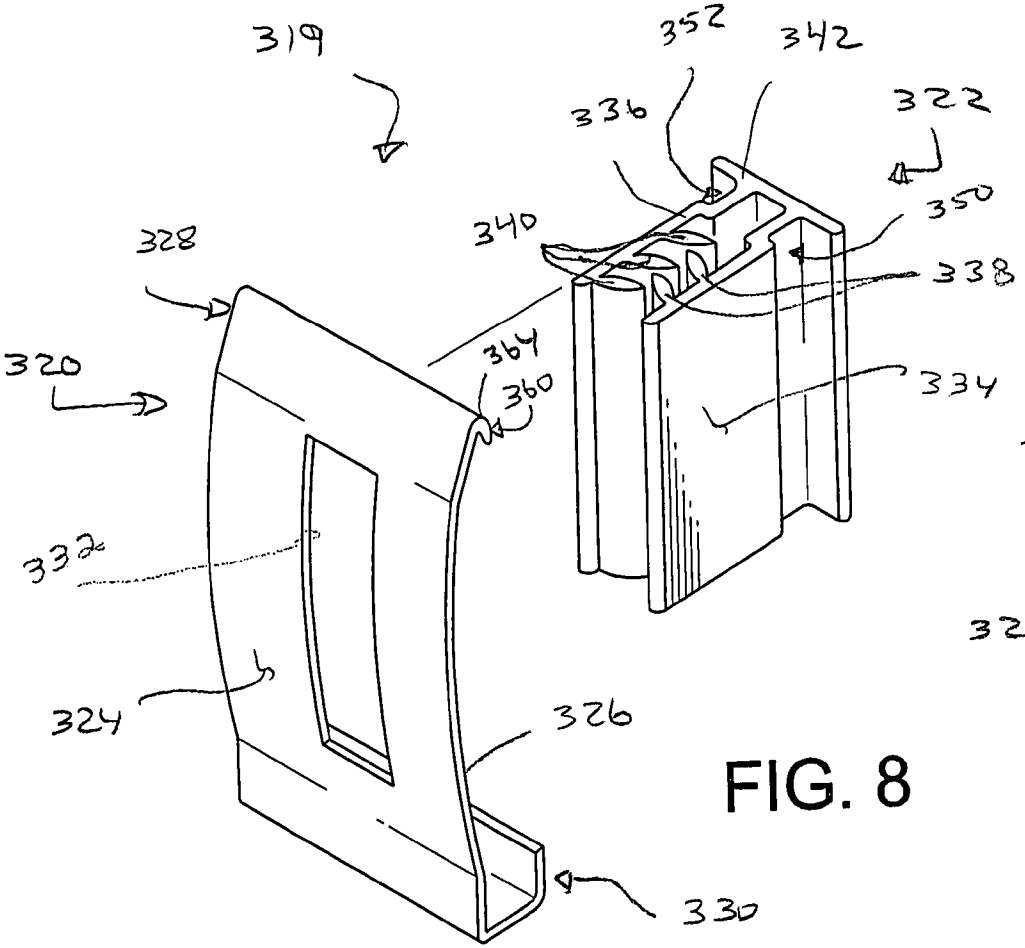
FIG. 8 is an exploded perspective view of a sign holder which can be employed with label holders of the second and third embodiments of the present invention.
Figure 10:
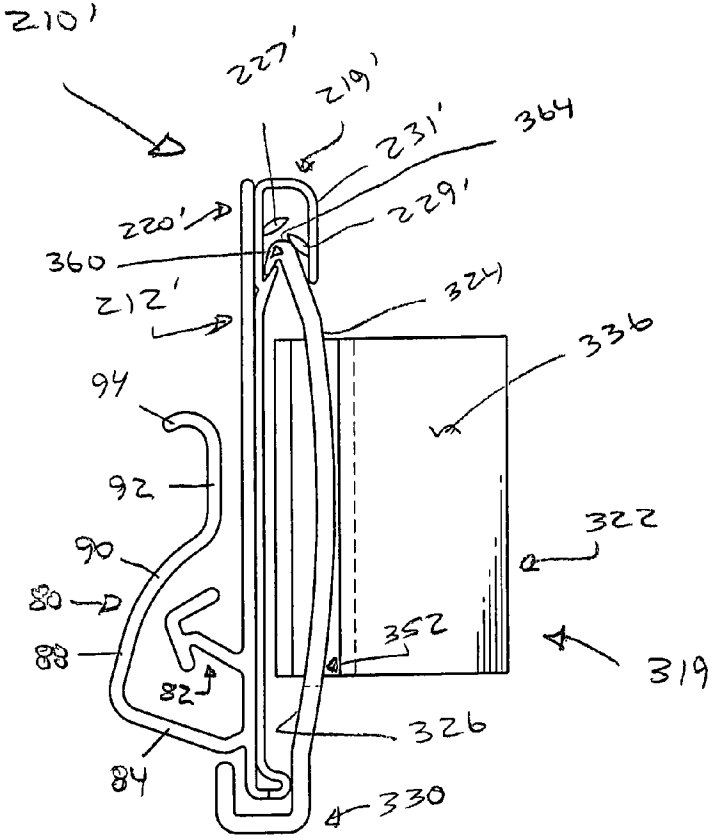
FIG. 10 is a side elevational view of the sign holder of FIG. 9 in a pre-mount orientation with the label holder of FIG. 5; and, FIG. 11 is a side elevational view of the holder of FIG. 10 in a mounted position in accordance with the present invention.

A third embodiment of a label holder according to the present invention is shown in FIG. 7, wherein two labels L1, L2 are displayed. Since this version of the invention is similar to that shown in FIGS. 5 and 6, like components are identified with like numerals with a double-primed (") suffix and new components are illustrated by new numerals. A first label L1 is displayed behind the cover panel 214" of the label holder 210" and is mounted between a body panel 312 and the cover panel 214". The second label L2 is retained by the sign holder 219". The body panel 312, as shown in FIG. 7, includes a curved wall 313 having an upper portion 315 which is disposed at an acute angle in relation to a plane of a remainder of the wall 317. The upper portion 315 extends upwardly and rearwardly from the cover panel 214". The upwardly and rearwardly extending upper portion 315 facilitates insertion and removal of labels L1 when the cover panel 214" is pivoted away from the body panel 312. It is to be appreciated that a rear surface of the overhang 219" at the upper end rests against a forward edge 73 of the upper flange 72 of an associated shelf 60 when in use (not shown). The sign holders 219, 219', 219" provide an additional retaining mechanism for holding labels L2 to cover a label L1 behind the cover panel 214, 214', 214", supplement the labels L1, and/or to communicate a different message than an existing label L1.

Referring now to FIGS. 8-11, a label or sign holder that can be used with the label holders of the second and third embodiments of the present invention is there illustrated. It is designated generally by the reference numeral 319, and comprises a mounting member 320 and a label or sign gripping member 322. The mounting member 320 has a front surface 324, a rear surface 326, an upper end 328, and a lower end 330. The mounting member 320 includes an opening 332 therein for receiving a portion of the sign gripping member 322. The sign gripping member 322 comprises a first sidewall 334, a second sidewall 336, a first fin or row of fins 338, a second fin or row of fins 340, and a flared base wall 342.

In the assembled position (FIG. 9), the sidewalls 334, 336 pass through the opening 332 of the mounting member 320. The sidewalls 334, 336 have inwardly extending notches 350, 352 proximal to the base wall 342. The sidewalls 334, 336 can be compressed toward one another as they pass through the opening 332 of the mounting member 320. Once the sign gripping member 322 is inserted to the notches 350, 352, the compressed sidewalls 334, 336 flare away from one another thereby frictionally securing the mounting member 320 to the sign gripping member 322 at the notches 350, 352. The fins 338, 340 can each extend more than half the distance between the sidewalls 334, 336 and can be interleaved. The fins 338, 340 can be made of more flexible material than the two sidewalls 334, 336.

Figure 11:
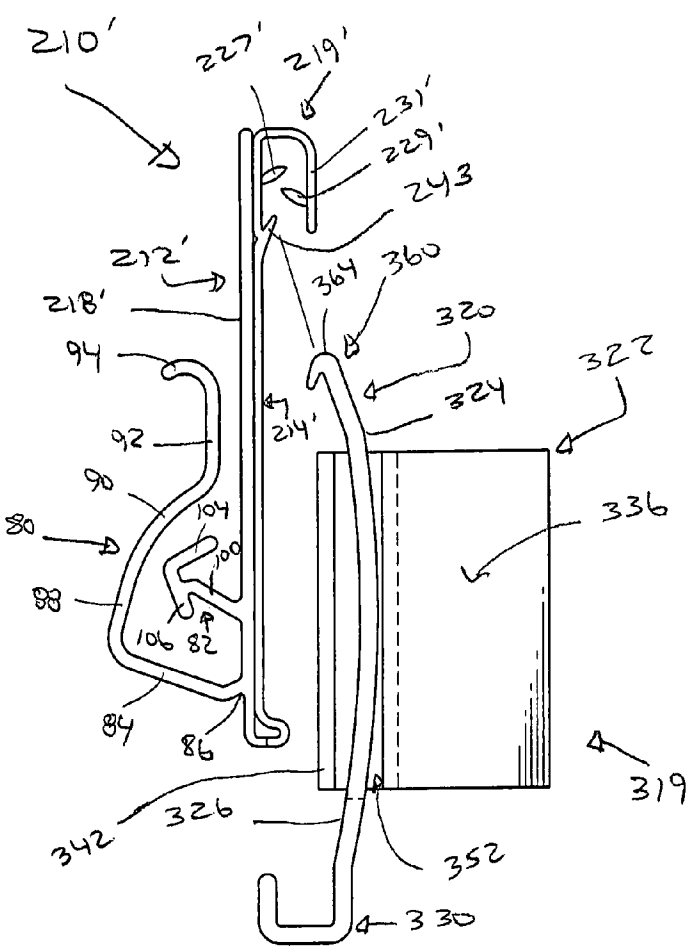

The mounting member 320 includes a finger 360 at the upper end 328 which can be hooked onto the ridge 243 of, for example, sign holder 210'. As shown in FIG. 11, finger 360 includes an apex 364 which contacts fin 229', while front surface 324 contacts outer end 231', thereby resisting dislodgement. In the mounted position (FIG. 11), the sign holder 319 orients labels or signs (not shown) normal to the cover panel 214'. It is to be appreciated that, in this arrangement, the signs placed in the sign holder 319 can be observed as one moves along an aisleway parallel to the shelves. The lower end 330 of the mounting member 320 includes a generally J-shape. In the mounted position shown in FIG. 11, the lower end 330 of the mounting member 320 hooks around the hinge 42 of the label holder 210', thereby providing a retaining support proximal to the point 86 of the clip member 80. The finger 360 in association with the ridge 243 of the cover panel 214' and the J-shaped portion 330 of the mounting member provides support and stability to the sign holder 319.

The present invention provides holders for price labels or similar which are sturdy, durable, and cost effective to manufacture. The holders are adapted for secure, selective attachment to a wide variety of different retail shelving types and accommodates multiple labels in different orientations.

The invention has been described with reference to several preferred embodiments. Obviously, alterations and modifications will occur to others upon a reading and understanding of this specification. It is intended to include all such modifications and alterations insofar as they come within the scope of the appended claims or the equivalents thereof.

Having thus described the invention, it is claimed:

1. A label holder comprising:

a body panel having a front surface, a rear surface, an upper end, and a lower end;

a first clip member extending rearwardly away from said rear surface and including a distal portion and a proximal portion;

a second clip member, spaced from said first clip member, wherein said second clip member includes:

a stem extending rearwardly away from said rear surface said stem including a downwardly oriented portion which extends towards said first clip member proximal portion; and, at least one arm extending from said stem and disposed adjacent said distal end of said stem wherein said second clip member at least one arm comprises a downwardly extending arm which extends toward said lower end of said body panel;

wherein said first and said second clip members cooperate to selectively hold between them a projecting portion of an associated shelf and wherein said first clip member generally defines an L-shape and is connected proximal to said lower end of said body panel; and, a cover panel connected to said body panel, said cover panel having a front surface, a rear surface, an upper end, and a lower end.

2. A label holder as set forth in claim 1, further comprising a hinge for connecting said lower end of said cover panel with said lower end of said body panel.

3. A label holder as set forth in claim 1, wherein said front surface of said body panel and said rear surface of said cover panel define a pocket therebetween for selectively accommodating an associated label.

4. The label holder as set forth in claim 1, wherein said second clip member at least one arm further comprises an upwardly extending arm which extends toward said rear surface of said body panel.

5. The label holder as set forth in claim 4, wherein said upwardly extending arm is oriented approximately transverse to said rear surface of said body panel.

6. The label holder as set forth in claim 5, wherein said upwardly extending arm includes a contact end for contacting said rear surface of said body panel thereby limiting upward movement of said stem member.

7. The label holder as set forth in claim 1, wherein said downwardly extending arm includes a contact end for contacting an end of the associated shelf thereby limiting movement of said holder in relation to the associated shelf.

8. A holder for a label, said holder comprising:

a cover panel having a front surface, a rear surface, an upper end, and a lower end;

a body panel having a front surface, a rear surface, an upper end, and a lower end;

a clip having a first portion secured to said rear surface of said body panel proximal to said lower end of said body panel, said clip extending rearwardly away from said body panel rear surface;

a hinge connecting said lower end of said cover panel with said lower end of said body panel;

a first sign holder mounted to said cover panel; and, a second sign holder selectively mounted to said cover panel wherein said second sign holder includes a finger positively engaging a ridge of said cover panel.

9. The label holder as set forth in claim 8, wherein said first sign holder comprises an overhang having a first flexible fin on said cover panel and a second flexible fin on said overhang.

10. The label holder as set forth in claim 8, wherein said ridge is directed towards said opening between said overhang and said cover panel.

11. The label holder as set forth in claim 9, wherein said fins each extend more than half the distance between said overhang and said cover panel.

12. The label holder as set forth in claim 9, wherein said fins are made of a more flexible material than said cover panel.

13. The label holder as set forth in claim 9, wherein said second sign holder is oriented approximately normal to said first sign holder.

14. The label holder as set forth in claim 9, wherein said second sign holder comprises a first side wall, a second side wall, a first fin, and a second fin.

15. The label holder set forth in claim 9, wherein said second sign holder comprises a mounting member and a sign gripping member.

16. The label holder as set forth in claim 14, wherein said fins each extend more than half the distance between said side walls and are interleaved.

17. The label holder as set forth in claim 14, wherein said fins are made of more flexible material than said two side walls.

18. A holder for a label, said holder comprising:

a cover panel having a front surface, a rear surface, an upper end, and a lower end;

a body panel having a front surface, a rear surface, an upper end, and a lower end;

a hinge connecting said lower end of said cover panel with said lower end of said body panel;

said cover panel including a sign gripping member;

a first clip member extending rearwardly away from said rear surface of said body panel;

a second clip member extending rearwardly away from said rear surface of said body panel, said second clip member being spaced from said first clip member, wherein said second clip member is approximately arrow-shaped in cross-section and includes a stem, an upwardly extending arm located adjacent a distal end of said stem, and a downwardly extending arm disposed adjacent said distal end of said stem; and, wherein said first and second clip members cooperate to selectively hold between them a projecting portion of an associated shelf.

19. A label holder comprising:

a rear panel;

a front panel secured to said rear panel along a bottom edge of said front panel;

a first gripping member extending rearwardly from said rear panel for selectively securing the label holder to an associated merchandising shelf;

a second gripping member extending rearwardly from said rear panel, said second gripping member being spaced from said first gripping member, wherein said first and second gripping members are of one piece with a first portion of said rear panel, wherein said second gripping member comprises:

a stem, and at least one arm extending from said stem wherein said at least one arm extends downwardly from said stem; and, wherein said first gripping member cooperates with said rear panel to form a pocket and said second gripping member is located entirely in said pocket.

20. The label holder of claim 19, wherein said first and second gripping members cooperate to hold a portion of the associated merchandising shelf between them.

21. The label holder of claim 19, wherein said first gripping member comprises:

a first portion oriented generally perpendicular to said rear panel;

a second portion connected to said first portion and oriented generally parallel to said rear panel;

a third portion, connected to said second portion and extending towards said rear panel;

a fourth portion, connected to said third portion and oriented generally parallel to said rear panel; and, a fifth portion, connected to said fourth portion and oriented generally perpendicular to said rear panel.

22. The label holder of claim 19, wherein said front panel comprises a transparent material.

23. The label holder of claim 22, wherein said front and rear panels cooperate to hold an associated merchandising label between them, the associated merchandising label being selectively removable from the label holder.

24. The label holder of claim 19 further comprising a first sign holder, said first sign holder being located on said front panel.

25. The label holder of claim 24 further comprising a second sign holder selectively securable to a portion of said front panel.

26. The label holder of claim 24 wherein said first sign holder comprises an overhang connected to said front panel, a first flexible fin located on said cover panel and a second flexible fin located on said overhang.

27. The label holder of claim 26 wherein said fins each extend more than half the distance between said overhang and said cover panel.

28. The label holder of claim 19 further comprising a ridge on said cover panel.

29. The label holder of claim 19 wherein said at least one arm is located adjacent a distal end of said stem.

30. The label holder of claim 19 said second gripping member comprises two arms.

31. A label holder comprising:

a body panel including a rear surface;

a first clip member extending away from said rear surface;

a second clip member extending away from said rear surface, wherein said second clip member is approximately arrow-shaped in cross-section and comprises:

a stem, and a head including a first arm and a second arm, said arms being angled in relation to each other wherein said first and second clips are spaced from each other and define a pocket between them; and, a cover panel connected to said body panel.

32. The label holder of claim 31 wherein said first clip member comprises a first portion which extends approximately parallel to said second clip member stem.

33. The label holder of claim 32 wherein said first clip member further comprises a second portion which extends approximately normal to said first portion.

34. The label holder of claim 33 wherein said first clip second portion includes a section that is aligned with and spaced from a tip of said second clip head.

35. The label holder of claim 33 wherein said first clip second portion and said second clip cooperate to define a throat leading to said pocket.

36. The label holder of claim 31 wherein said first clip includes a first portion located beneath said second clip, a second portion coplanar with and spaced from a distal end of said second clip and a third portion located above said second clip.

37. The label holder of claim 36 wherein said first clip further includes a fourth portion located above said third portion and extending at an angle thereto.

* * * * *